United States Patent [19]

Passadore

[11] Patent Number: 4,859,140

[45] Date of Patent: Aug. 22, 1989

[54] CENTRIFUGAL FAN

[75] Inventor: Albert M. Passadore, Boring, Oreg.

[73] Assignee: Brod & McClung - Pace Co., Portland, Oreg.

[21] Appl. No.: 874,801

[22] Filed: Jun. 13, 1986

Related U.S. Application Data

[63] Continuation-in-part of Ser. No. 695,175, Jan. 25, 1985, abandoned.

[51] Int. Cl.[4] ..... F04D 29/56

[52] U.S. Cl. ..... 415/48; 415/157

[58] Field of Search ..... 415/26, 47, 48, 131, 415/132, 210 R, 157, 158, 150; 198/41.2

[56] References Cited

U.S. PATENT DOCUMENTS

| | | | |
|---|---|---|---|
| 2,143,100 | 1/1939 | Anderson | 415/157 X |
| 2,771,239 | 11/1956 | Moreillon | 415/157 |
| 2,993,640 | 7/1961 | Moreillon | 415/157 X |
| 3,625,629 | 12/1971 | Morrison et al. | 415/157 |
| 3,861,824 | 1/1975 | Sjoqvist et al. | 415/157 |
| 4,050,660 | 9/1977 | Eggmann et al. | 415/219 R X |
| 4,253,796 | 3/1981 | Philipps et al. | 415/157 |

FOREIGN PATENT DOCUMENTS

| | | | |
|---|---|---|---|
| 2943238 | 5/1981 | Fed. Rep. of Germany | 415/157 |
| 3032087 | 4/1982 | Fed. Rep. of Germany | 415/157 |
| 50-65714 | 4/1974 | Japan | 415/157 |
| 42588 | 12/1958 | Poland | 415/157 |
| 606328 | 8/1948 | United Kingdom | 415/157 |

*Primary Examiner*—Robert E. Garrett
*Assistant Examiner*—Joseph M. Pitko
*Attorney, Agent, or Firm*—Klarquist, Sparkman, Campbell, Leigh & Whinston

[57] ABSTRACT

A centrifugal fan in which the cone and wheel have a telescoping relationship to vary the rated capacity of the fan. The mechanism effects the relative movement manually, or by a servo arrangement responsive to system pressure. The telescoping relationship includes an anti-recirculation sleeve on the cone. The wheel and cone can be moved to effect engagement of the cone and the wheel back plate to cut off the fan, when in a parallel arrangement, and to arrest wheel movement, after the drive to the wheel has been stopped. In another aspect, the cone and wheel are bodily stationary and a separate movable flow control sleeve is positioned to control flow.

13 Claims, 6 Drawing Sheets

CENTRIFUGAL FAN036

This application is a continuation-in-part of previous application filed Jan. 25, 1985, Ser. No. 695,175, entitled IMPROVED CENTRIFUGAL FAN, now abandoned.

BACKGROUND OF THE INVENTION

This invention relates to centrifugal fans and centrifugal fan systems, and particularly to those for commercial application.

In the past, in the era of low cost energy, it was not uncommon to simply ignore the fact that in industrial applications, the system's volume requirements varied from time to time. A constant rpm motor was simply allowed to run at its rated speed with the cost of doing so borne by the user.

With the advent of an increase in energy cost, and for other reasons, there has been more emphasis in recent years for fan systems wherein the rated capacity of a centrifugal fan could be varied to match the volume of air required by the system, to thereby achieve a horsepower reduction. While there are a number of ways of approaching this problem, three have been most often utilized. In one set up, a variable speed drive is interposed between the motor and the centrifugal fan itself, so while the motor is operating at a constant speed, the fan operates at a variable one. This is not wholly satisfactory because of the cost of the variable speed drive itself and the cost of maintaining it.

Another solution is to make use of the improvements in variable speed electrical motors, and particularly AC inverter motors. They enable the electrical motor to be driven at a variable speed in accordance with the volume demands of the system. However, they are expensive.

The third approach is to allow the motor to operate at a constant speed, but to provide dampers or vanes in front of the inlet cone. This means that the rated capacity of the fan depends on the position of the vanes. This does achieve a reduction in horsepower, but the fans are noisy.

SUMMARY OF THE INVENTION

The present invention provides a centrifugal fan whose rated capacity can be matched to the demands for air by the system, but which avoids the expense and maintenance problems of the variable speed drive and the expense of the AC inverter motor, while being much less noisy than a fan equipped with vanes or dampers.

More specifically, the present invention mounts the cone and rotating wheel so that they have a telescoping relationship of the cone within the wheel, to vary the rated capacity of the fan in accordance with the extent of telescoping, all without recirculation problems.

A main object of the present invention is to provide an improved centrifugal fan whose rated capacity can be varied, wherein the concepts are adaptable for either plug fan construction or volute housing construction.

Another object of the invention is to provide a centrifugal fan in which the rated capacity can be varied over a larger range than in other types of centrifugal fans.

Another preferred form of the invention comprises an arrangement whereby the cone is bodily stationary, and the wheel is bodily stationary, although of course rotating, and a separate flow control sleeve is slidably disposed between the exterior of the cone and the interior of the wheel for air volume control purposes.

Various other objects of the invention will be apparent from the following description taken in connection with the accompanying drawings, wherein:

DETAILED DESCRIPTION OF PREFERRED EMBODIMENTS

Figure 1:
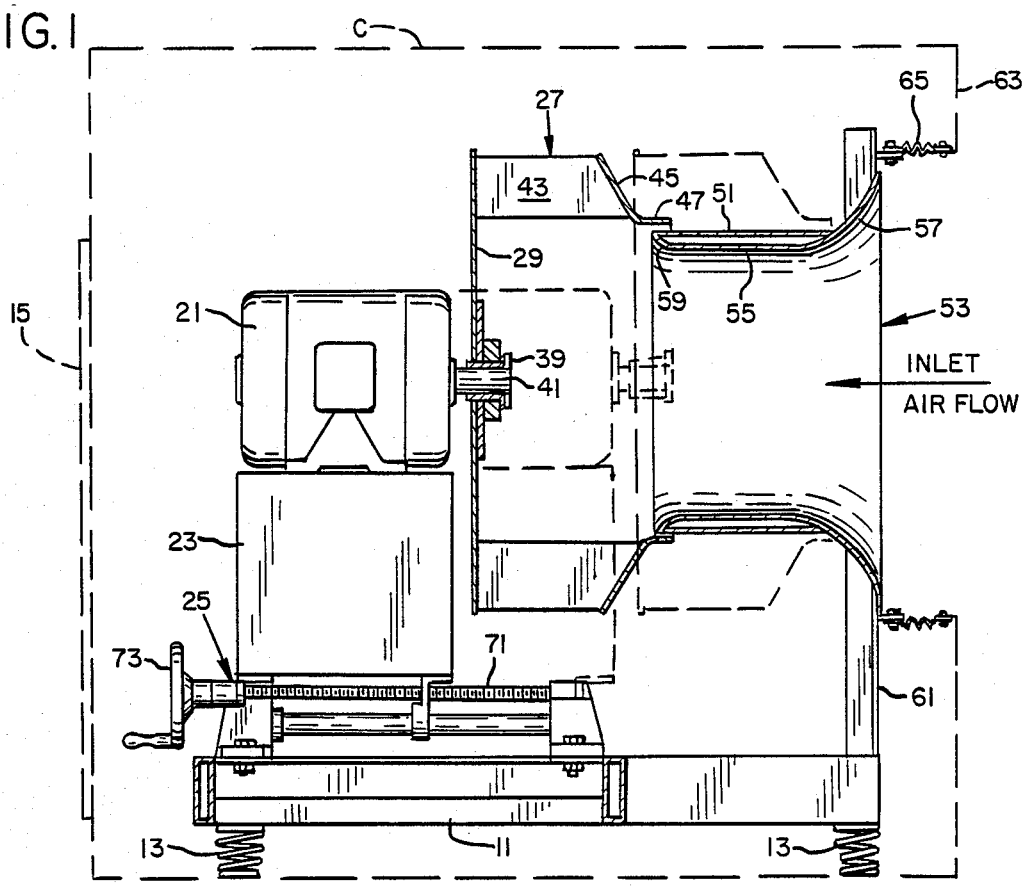
FIG. 1 is a side elevational view with some parts in section, showing a plug fan incorporating the concepts of the present invention.
Figure 2:
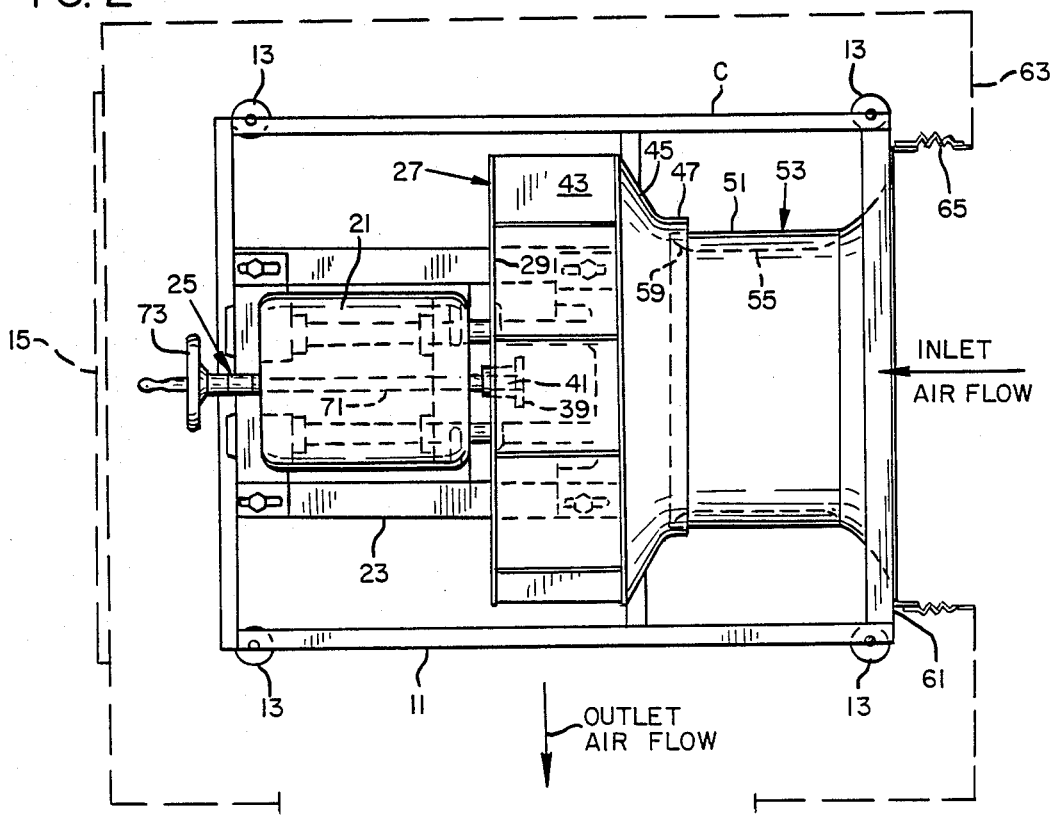
FIG. 2 is a plan view of the FIG. 1 arrangement.

FIG. 1 shows a plug fan incorporating the concepts of my invention, the plug fan typically being eventually enclosed within a cabinet C which is typically supplied by the user, or the manufacturer. In any event, the plug fan includes a base 11 which may be supported by spring or resilient mounts 13 on the floor of the cabinet for vibration isolation purposes. The cabinet typically has an access door 15 at its back end which can be removed for adjustment or maintenance purposes. It also has an outlet 17.

A constant speed electric motor 21, supported by a pedestal 23 and a movement adjustment mechanism 25 on the base 11, supports and drives a centrifugal fan wheel 27.

The fan wheel has a back plate 29 equipped with a collar arrangement shown as a taper-lock bushing 39 by which the wheel is mounted on the drive shaft 41 of the fan motor 21. The wheel has a number of blades 43 distributed about the wheel and fixed at their opposite ends to the back plate 29 and to a shroud plate 45. The shroud plate 45 is formed with a forwardly projecting snout 47 which slidably fits over an anti-recirculation sleeve 51 of the present invention provided exteriorly on a cone generally entitled 53, with which it has a telescopic relationship.

The cone has a throat section 55, with the curvature shown being a typical one, flaring distinctly outwardly at its front end at 57, and flaring outwardly at 59 at its rear, and being fixedly secured to an upstanding frame work section 61 on the base 11. The cone has its forward face spaced inwardly from the forward face 63 of the cabinet 15 but is connected to the forward face by an annular bellows or flex connection 65. The bellows or flex connection isolates the vibration of the fan proper from the cabinet, yet prevents the escape of air from the cabinet confining it to travel through the cone 53.

Now, returning to the mechanism 25, it, in and of itself, is old and well-known in the art and can be, for instance, a Gerbing adjustable motor base having a lead screw 71 and a crank handle 73 by which the motor and thus the wheel 27 can be adjusted fore and aft within the cabinet, to vary the telescopic relationship of the cone and wheel.

In operation, let it be assumed that a centrifugal fan of the present invention is installed in a system in which the demands for air are within the rated capacity of the centrifugal fan.

A pressure measurement can be made at various places along the system, to give an indication of the volume of air supplied by the system. Should the volume requirements of the system vary, an adjustment can be made via the crank handle 73 to telescope the cone into the wheel to thereby match the rated fan capacity to the volumetric requirements of the system.

Figure 6:
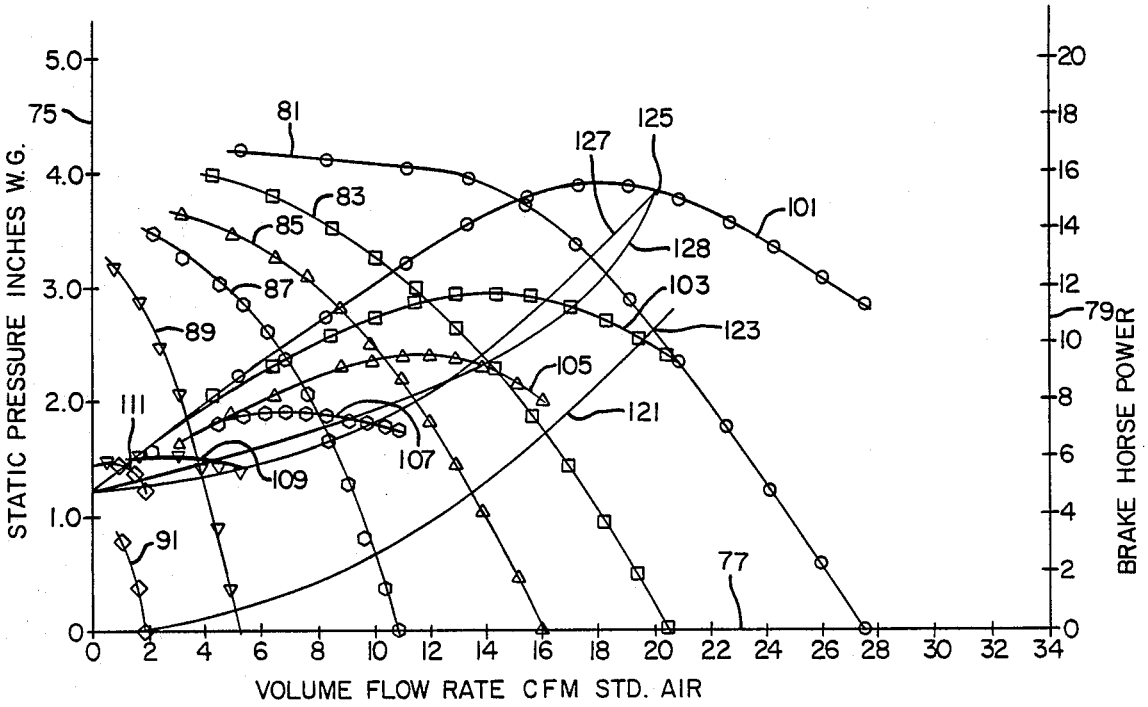
FIG. 6 is a graph of certain operating parameters of a fan of the present invention.

Reference is made to the graph, FIG. 6. It will be understood that this graph is for a particular fan operating at a particular speed, and that each fan will have its own graph curves unique to that fan and its speed of operation.

The left hand ordinant 75 is in terms of static pressure, inches water gauge. The abscissa 77 is in terms of volume flow rate, cubic feet per minute, given in thousands. The right hand ordinant 79 is in terms of brake horsepower.

There is a first set or family of curves, the curves being individually identified as 81, 83, 85, 87, 89 and 91, which are static pressure/volume curves for various telescopic settings of the fan. Curve 81 is for zero telescoping, whereas curve 83 is for a three inch projection of the cone into the wheel, 85 being a six inch projection; 87 being a nine inch projection; 89 a twelve inch projection; while 91 is a thirteen and one-half inch projection, at which the inner end of the cone is close to the back plate.

There is a second set or family of curves of brake horsepower/volume, labeled 101, 103, 105, 107, 109 and 111, corresponding to the settings respectively of curves 81–91.

Curve 121 is a static pressure/volume system curve for a particular air flow system which is to be supplied with air. The one shown is simply one out of many that could be encountered.

The place where the system curve 121 intersects the first family of curves indicates the operating points for each of the settings. For instance, the system curve 121 intersects curve 81 at point 123, which is at about 2.75 inches W/G, and a volume flow rate of 20 (20,000 cubic feet per minute). The brake horsepower required at this setting is found at the point where a vertical line through point 123 intersects the corresponding brake horsepower curve 101, which turns out to be at point 125, somewhat slightly above 15 brake horsepower.

Proceeding with the above method establishes a series of points through which a brake horsepower reduction curve 127 can be drawn. Curve 128 is a brake horsepower reduction curve for a fan having conical inlet vanes.

It is evident that for flow rates between 13,000 cubic feet per minute and 20,000 cubic feet per minute, the conical inlet vane fan has a slight advantage, insofar as brake horsepower is concerned, but of course, not insofar as noise is concerned, the fan of the present invention being much quieter than a conical inlet vane fan. For volume requirements between zero and 13,000 cubic feet per minute, the present system not only is quieter but requires less brake horsepower.

With a fan of the present invention, not only the manufacturer but the distributor can reduce his inventory, because the fan capacity can be readily altered by appropriate setting of the telescopic adjustment. The present invention thus allows the rated capacity of a fan to be changed to meet the demands of a particular system, all the while operating more quietly than a fan equipped with dampers or vanes.

The above described centrifugal fan is not adapted for air systems in which the demands for air vary frequently, particularly during a day. Where frequent adjustment is required, a control system is provided in which the analog output of a pressure sensor or transducer is utilized, via a servo arrangement to so control a prime mover as to cause telescoping proportional to the value of the output from the sensor. Typical of the analog-to-analog servo systems that might be used is a static pressure controller such as a Honeywell PT9004A unit.

Figure 3:
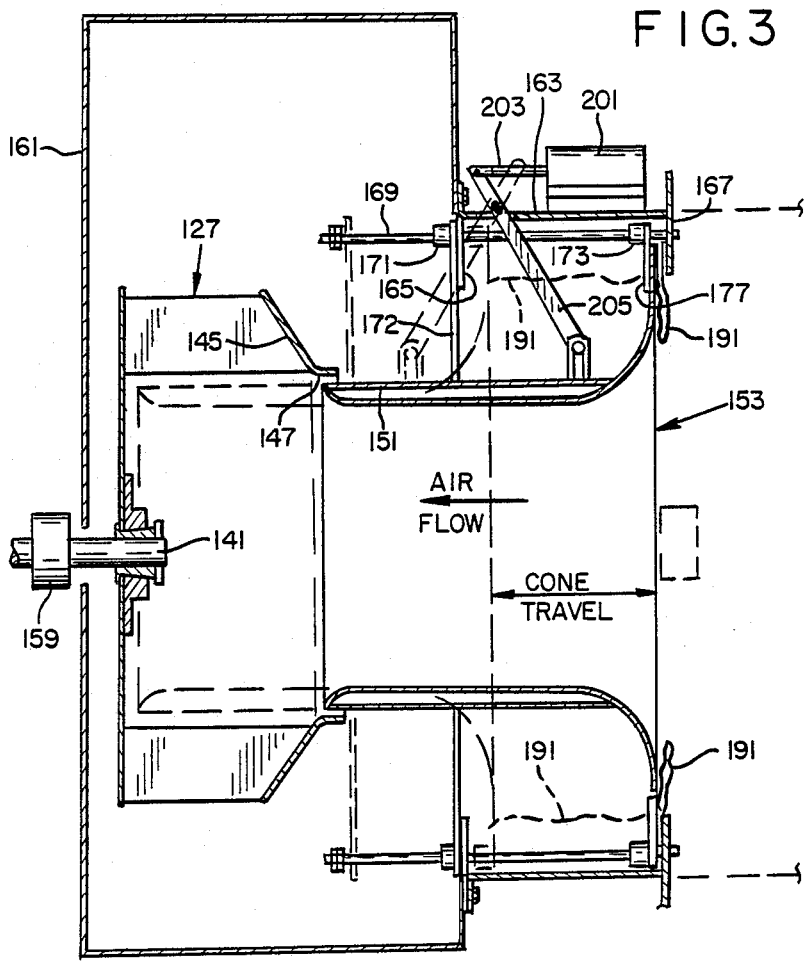
FIG. 3 is a side elevational view, partially in section, of a housed fan, incorporating the concepts of the present invention.
Figure 4:
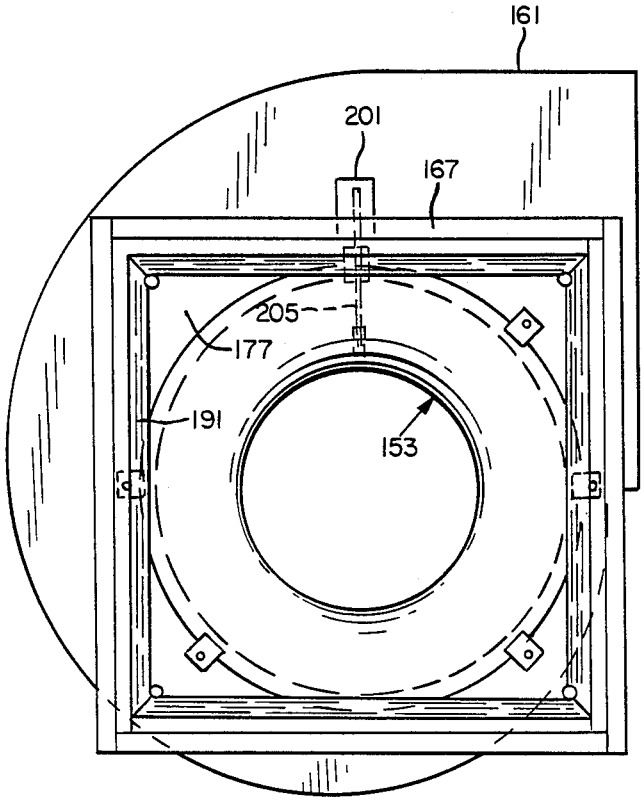
FIG. 4 is an elevational view taken 90 degrees from that in FIG. 3.

FIGS. 3 and 4 show a single width housed fan incorporating the concepts of the present invention. There is an inlet cone 153 and a fan wheel 127 into which the left hand portion of the cone telescopes, the wheel having a shaft 141 supported by a bearing 159 at the rear of the volute housing 161. The housing in and of itself is of conventional form and its typical volute shape is shown in FIG. 4.

The cone 153 is supported as follows. The housing at its right hand portion, as the parts are shown in FIG. 3, is provided with a supporting arrangement in the form of a large tube 163, provided with inwardly extending flanges 165 and 167. These flanges support a series of horizontal rods 169 which are part of a linear motion bearing arrangement. Movable along the rods are a series of inner bearings 171 mounted on a stabilizing plate 172, and an outer set of bearings 173 of the front of the cone 153.

By the above arrangement, it is evident that the cone is mounted for fore and aft movement along the rods 169 to telescope the left hand portion of the cone 153 into the wheel 127. An annular bellows-like flexible connection at 191 prevents the escape of air past the stabilizer plate at the place the cone passes through it.

It is evident that the arrangement above described has an anti-recirculation sleeve 151 telescoping within the nose portion 147 of the shroud 145 at the right hand portion of the fan, as the parts are shown in FIG. 3.

The cone in FIG. 3 may be moved either manually, as shown in FIG. 1, or by power as shown in FIG. 3. A motor 201, mounted on a tube 163, has an actuating shaft 203 operating a lever 205 having elongate slots at its opposite ends, operatively connecting the lever to the shaft 203 and the cone.

Again, a closed loop servo set-up of some type will be utilized to adjust the position of the cone in accordance with the output of a pressure transducer in the system.

Figure 5:
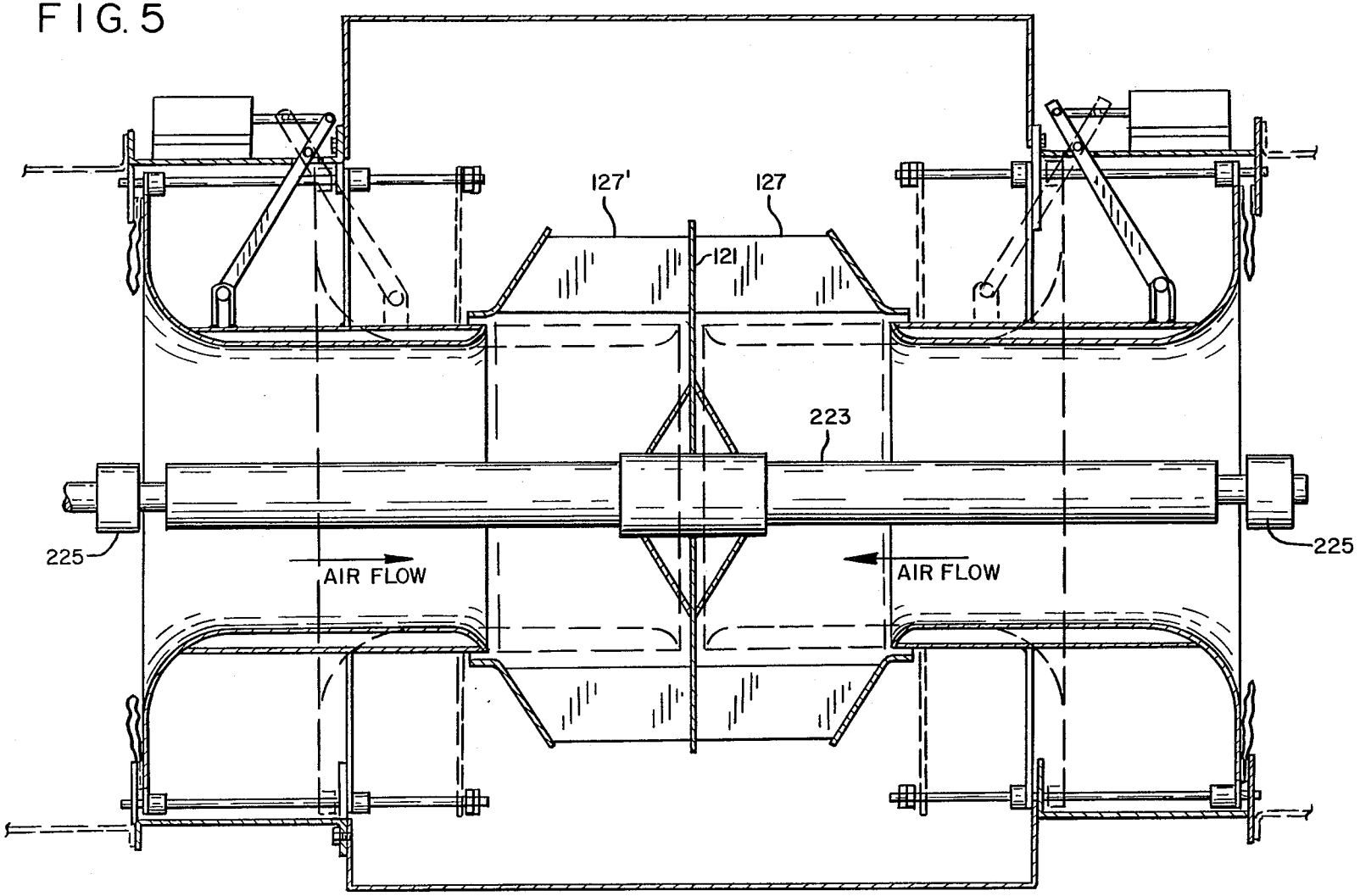
FIG. 5 is an elevational view partly in section of a double width housed fan incorporating the concepts of the present invention.

FIG. 5 replicates the arrangement in FIG. 3 to provide a double width housed fan construction, in which the wheel is bodily stationary. There is not only a right wheel 127 but also a left wheel 127', the two being separated by a centerplate 221, and both being mounted on a shaft 223 supported by bearings 225 at the opposite ends of the fan. The housing, of course, is of double width and of the same shape as shown in FIG. 4. The adjusting arrangement is the same as shown in FIG. 3, although it could be manual if desired.

The centerplate 221 functions as a back plate for both fans.

An advantage of the fan of the present invention is that it permits staggering of the outputs of a series of such fans. That is to say, if it is desired, in a parallel fan system, to take one of the fans out of operation, that fan is turned off. After its wheel comes to rest, an override control is operated to cause the cone to bottom against the back plate, thereby closing off any substantial flow through that particular fan. This means that the remaining fans thereafter are the ones that supply air to the system, to the exclusion of the fan which has been in effect closed down, not only electrically, but also pneumatically.

Note that engagment between the cone and the wheel back plate prevents a counter rotation of the wheel, which previously was accomplished by a specially provided wheel arrester.

The fan of the present invention, in addition to being distinctly less noisy than a fan having conical inlet vanes, has an effective operation range greater than the latter.

Figure 7:
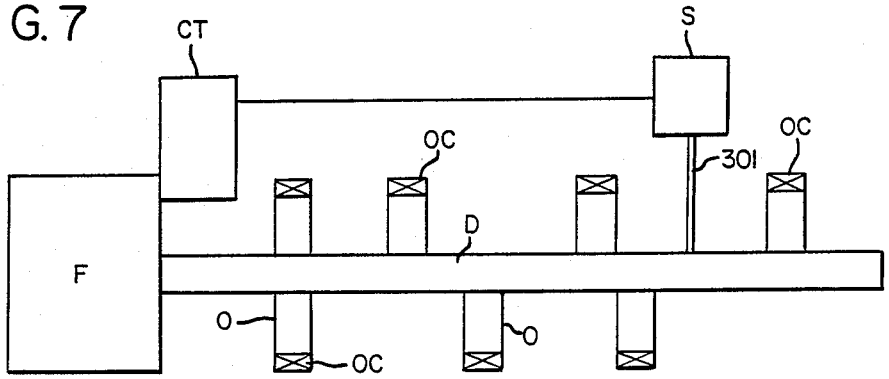
FIG. 7 is a schematic view of an air system incorporating the concepts of the present invention.

FIG. 7 shows an air ductwork system incorporating the concepts of the present invention. There is a fan F connected to the ductwork D which has plural outlets O with outlet controllers C in the form of valves, dampers, vanes or whatever is desired. There is an air pressure sensor S connected at 301 to the ductwork D. A position controller CT is operatively connected to either the cone or wheel, or both, and is operatively connected to the sensor so as to cause variations in the telescopic setting in accordance with the changes in the pressure detected by the sensor.

By a constant speed motor, I mean either a motor operating at only one constant speed, or a motor that can operate at more than one constant speed (by way of example, one that can operate at 1800 or 900 rpm).

Modified Form of the Invention

Figure 8:
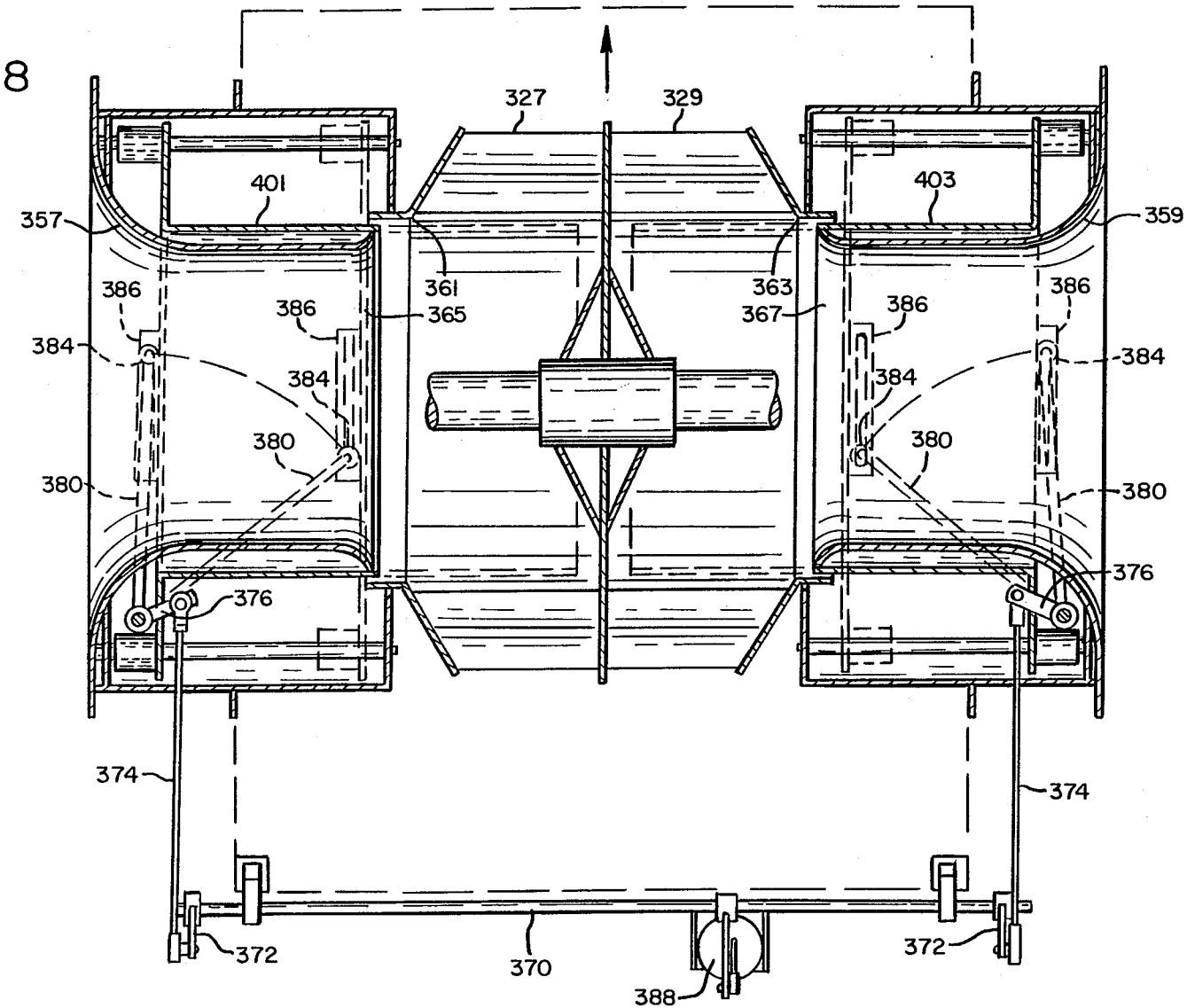
FIG. 8 is a schematic, overhead plan view of a modified form of the invention.
Figure 9:
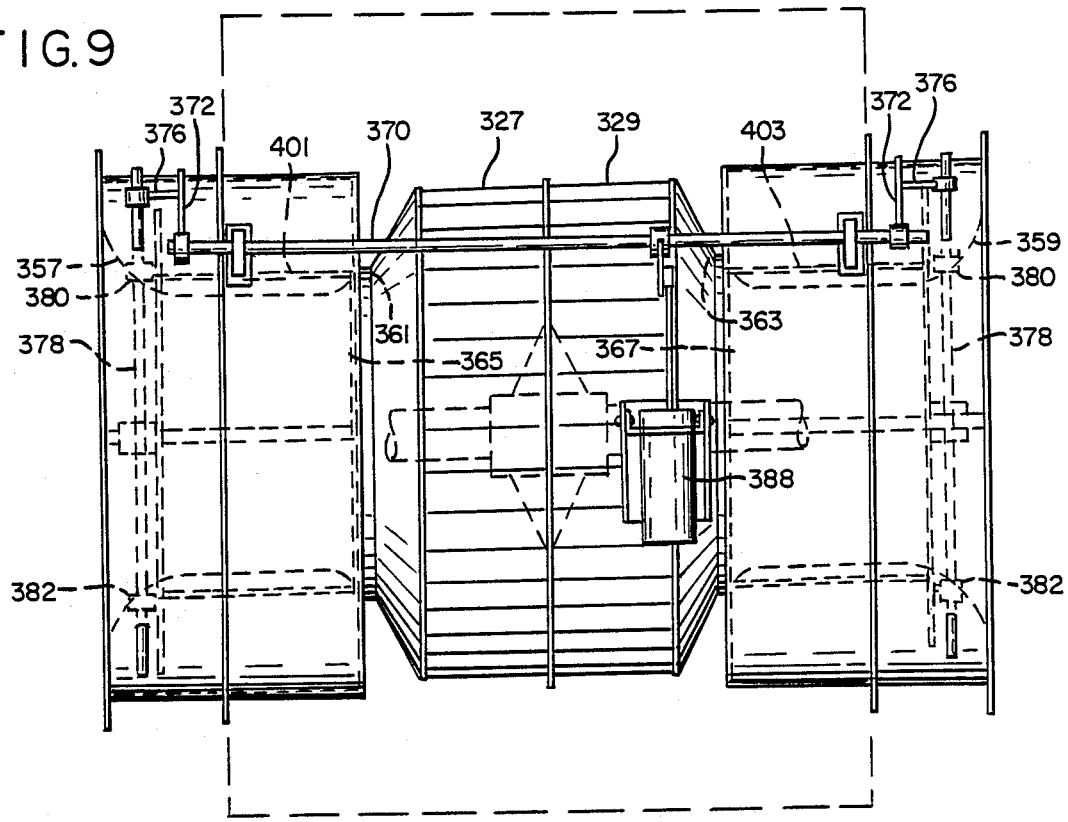
FIG. 9 is a rear elevation view of the modified form of the invention.
Figure 10:
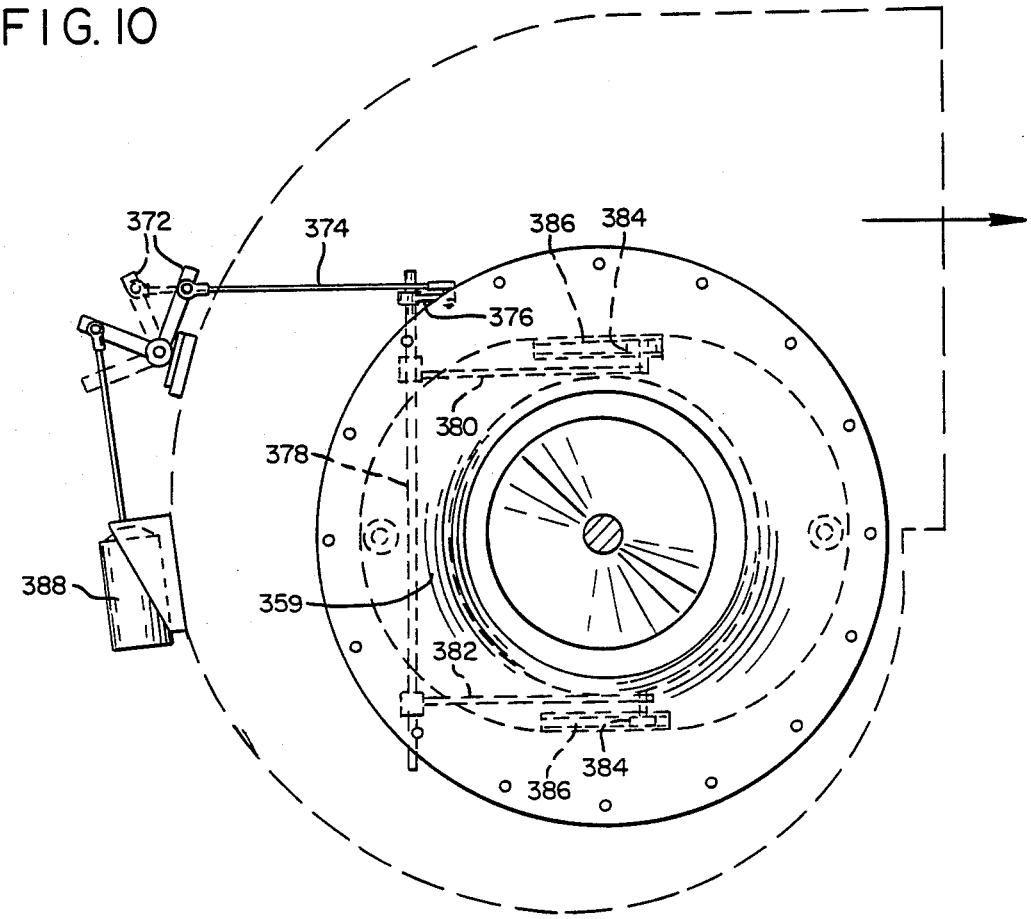
FIG. 10 is a side elevation view of the modified form of the invention.

Now, referring to FIGS. 8–10, there is disclosed a modified form of the invention in which the fan wheels 327 and 329 are bodily stationary, although of course rotating. The cones 357 and 359 are also bodily stationary. Surrounding the inner portions of the cones 357 and 359 are sleeves or cylinders, 401 and 403, respectively, which have a slidable relationship between the nose portions 361 and 363, respectively, of the wheels and the inner ends 365 and 367, respectively, of the cones 357 and 359.

The mode of operation includes a position-adjusting mechanism for adjusting the position of the sleeves relative to the wheels so that the interior of the wheels are masked in proportion to the particular position of the sleeves.

Note that each sleeve is exterior of the air contacting portions of the associated cone so that the air travel characteristics provided by the cone are not interfered with by the sleeve. Note also that when the sleeve is fully retracted, it has no effect on the air flow control at all. It is only when the sleeve is moved inward to a masking position that its effect on the flow of air comes into play.

To adjust the position of the sleeves, a control mechanism is provided which makes use of a jackshaft 370 (FIG. 8) alongside the structure so as to be able to control both sleeves in the depicted double wheel unit. Bear in mind that a simpler mechanism could be provided for controlling the position of a single wheel unit.

The jackshaft 370 has a crank 372 (FIG. 10) at each end. The free end of each crank 372 is pivotally connected to a thrust rod 374 which in turn is pivotally connected to one end of crank arm 376. The crank arm 376 is carried by a drive shaft 378. Two crank arms 380, 382 are fixedly mounted on drive shaft 378. The free end of each crank arm 380, 382, carries a roller 384. The rollers are disposed within tracks 386, respectively, fixed on the exteriors of the associated sleeves. Jackshaft 370 is turned by an actuator motor 388.

It is evident that when jackshaft 370 is turned by actuator motor 388, thrust rods 374 will turn drive shafts 378, which moves crank arms 380, 382 inward or outward, to cause appropriate inward or outward movements of the sleeves.

It will be obvious to those skilled in the art that the above jackshaft arrangement or something similar could be used to move the cone in the first described embodiment of the invention.

While I have shown and described a preferred embodiment of my invention, it will be apparent to those skilled in the art that changes and modifications may be made without departing from my invention in its broader aspects. I therefore intend the appended claims to cover all such changes and modifications as fall within the true spirit and scope of my invention.

What is claimed is:

1. An air system comprising:

an air conducting ductwork having plural outlets;

an area controller for each of at least some of the outlets;

a centrifugal fan connected to said ductwork;

said fan having a cone and a wheel in telescopic relationship of the cone within the wheel;

at least one air pressure sensor connected to said ductwork; and a servo position controller interconnecting said sensor to at least one of said cone and wheel for effecting relative positional control over the telescopic relationship of the same in accordance with the variations of air pressure at said sensor.

2. A centrifugal fan comprising:

a rotary bladed wheel having a central opening with an entry mouth of circular form;

an inlet cone for directing air into said wheel having an inlet and an outlet end, said inlet cone having a non-cylindrical interior surface for air flow management;

means mounting said wheel and cone for relative telescopic movement of the outlet end of said cone into said wheel at said mouth, to vary the volume of air moved by said fan;

said cone having an anti-recirculating sleeve of cylindrical shape telescopically received by said circular mouth;

a housing enclosing said wheel and said cone;

means within said housing spring-supporting said wheel and cone;

said housing having an inlet opening; and a bellows connecting the inlet of said cone to said housing at said inlet opening.

3. A centrifugal fan comprising:

a rotary bladed wheel, disposed in a bodily stationary position;

inlet cone means for directing air into said wheel, said cone means having an inlet and outlet end, said inlet cone means being bodily stationary;

sleeve means slidably interposed between the outlet end of said inlet cone and interior of said wheel for reducing the effective area of the interior of said wheel; and means for moving the sleeve means axially to disposed it in a desired masking position at the interior of the wheel so as to controllably starve the wheel for air.

4. The centrifugal fan of claim 3 wherein said sleeve surrounds the exterior of said inlet cone.

5. The centrifugal fan of claim 3 wherein the means for moving the sleeve axially comprises a jackshaft operatively interconnected with the sleeve for effecting axial movement of the same.

6. The centrifugal fan of claim 5 including:

a first crank arm secured to the jackshaft;

a drive shaft;

a second crank arm secured to the drive shaft;

a push rod extending between the first and second crank arms, the push rod being pivotally connected to the first and second crank arms;

a third crank arm secured to the drive shaft;

a roller track secured to the sleeve, the third crank arm being rollably connected to the roller track whereby said first, second, and third crank arms, push rod, drive shaft and roller track cooperate for providing axial movement of said sleeve upon turning of said jackshaft.

7. The centrifugal fan of claim 3 in which the last named means moves the sleeve from a retracted position in which it does not hinder the supply of sair to the interior of the wheel to an extended position in which it entirely blocks the supply of air to the interior of the wheel.

8. The centrifugal fan of claim 7 in which the fan further includes anti-recirculation means for preventing air that has not first passed through the inlet cone from entering the interior of the wheel.

9. The centrifugal fan of claim 3 in which a portion of the sleeve means that is movable into the interior of the wheel has tubular outer surface for positioning adjacent the inner edges of blades attached about the periphery of the wheel, to thereby more effectively reduce the effective area of the interior of the wheel.

10. The centrifugal fan of claim 3 in which the outlet end of the cone means extends into the inside of the wheel.

11. A centrifugal fan comprising:

a rotary bladed wheel having a central opening with an entry mouth of circular form;

an intake cone for directing air into said wheel, said intake cone having an inlet and an outlet, said intake cone further having a non-cylindrical interior surface for air flow management and having a cylindrical outer surface for preventing recirculation;

a housing including a pressurized chamber into which air is urged by the rotary bladed wheel, one of the boundaries of said pressurized chamber being the cylindrical outer surface of the intake cone;

bearing means mounted to said wheel and intake cone permitting relative telescopic movement of the outlet of said cone into the entry mouth of said wheel; and motive means for moving the intake cone relative to the wheel so as to controllably starve the wheel for air.

12. The fan of claim 11 in which the motive means includes a first member attached to the housing, a second member attached to the intake cone and means coupled to said members for effecting relative movement therebetween, said motive means being positioned externally of an imaginary cylinder defined by the circular entry mouth of the rotary bladed wheel and extending axially therefrom, whereby the motive means does not interfere with the flow of air into the inlet of the intake cone.

13. The fan of claim 12 in which one of the boundaries of said pressurized chamber is a flexible sealing member coupled between the housing and the inlet of the intake cone to seal any air gap therebetween regardless of the intake cone's position relative to the housing.

* * * * *